US005486653A

United States Patent [19]

Dohi

[11] Patent Number: 5,486,653

[45] Date of Patent: Jan. 23, 1996

[54] CRIMP-STYLE TERMINAL

[75] Inventor: Hikoo Dohi, Shizuoka, Japan

[73] Assignee: Yazaki Corporation, Tokyo, Japan

[21] Appl. No.: 233,931

[22] Filed: Apr. 28, 1994

[30] Foreign Application Priority Data

Apr. 27, 1993 [JP] Japan ..... 5-022209 U

[51] Int. Cl.[6] ..... H01K 4/18

[52] U.S. Cl. ..... 174/84 C; 174/94 R; 439/877; 439/872

[58] Field of Search ..... 174/84 C, 94 R; 439/877, 882

[56] References Cited

U.S. PATENT DOCUMENTS

| | | | |
|---|---|---|---|
| 1,631,719 | 6/1927 | Chandler . | |
| 2,600,012 | 6/1952 | Macy . | |
| 3,051,733 | 8/1962 | Batcheller | 174/94 R |
| 3,522,577 | 8/1970 | Zak . | |
| 4,812,138 | 3/1989 | Condo et al. | 439/865 |
| 4,815,200 | 3/1989 | Ito | 439/877 |
| 5,025,554 | 6/1991 | Dohi | 439/877 |
| 5,338,233 | 8/1994 | Endo et al. | 439/877 |

FOREIGN PATENT DOCUMENTS

| | | | |
|---|---|---|---|
| 53-29834 | 8/1978 | Japan . | |
| 58-47839 | 10/1983 | Japan . | |
| 103876 | 4/1990 | Japan | 439/877 |
| 2202696 | 9/1988 | United Kingdom | 439/877 |

*Primary Examiner*—Morris H. Nimmo

*Attorney, Agent, or Firm*—Wigman, Cohen, Leitner & Myers

[57] ABSTRACT

A crimp-style terminal crimped to connect itself with an end of an electric wire includes an electric connecting part which is electrically connected to the other connecting part; and a crimping part formed integrally with the electric connecting part. The crimping part includes a bottom part and a pair of bends protruding from both sides of the bottom part. Each of the bends is formed to be thinner than the bottom part. In crimping, the pair of bends are deformed in such a manner that each end of the bends is directed to a substantially intermediate position in the width direction of the bottom part, whereby the end of the electric wire is crimped to the terminal securely.

12 Claims, 9 Drawing Sheets

TERMINAL THICKNESS = 0.6
WIRE SECTIONAL AREA = 0.5
C/W = 3.15
BARREL LENGTH = 9.1

CRIMP-STYLE TERMINAL

BACKGROUND OF THE INVENTION

This invention relates to a crimp-style terminal crimped to connect with an end of an electric wire.

A conventional crimp-style terminal for thin wires is disclosed in Japanese Patent Publication No. 58-47839 (Kokoku). In addition, Japanese Patent Publication No. 53-29834 (Kokoku) discloses a terminal having a crimping portion formed with recesses on the outer surface thereof.

However, in the conventional crimp-style terminal, when the thin wire is fastened to the terminal of enough thickness to satisfy the performance requirements of the electric connecting part, a large deviation in the contact resistance is produced, thus decreasing the reliability of it's electrical performance.

SUMMARY OF THE INVENTION

It is an object of the present invention to provide a crimp-style terminal capable of decreasing the deviation in the contact resistance in case of fastening the thin wire to the terminal of enough thickness.

The objects of the invention described above can be accomplished by a crimp-style terminal crimped to connect itself with an end of an electric wire, comprising:

an electric connecting part which is electrically connected to the other connecting part; and a crimping part formed integrally with the electric connecting part, the crimping part including a bottom part and a pair of bends protruding from both sides of the bottom part, each of the bends being formed to be thinner than the bottom part;

wherein the pair of bends being thinner than the bottom part and being deformed in such a manner that each end of the bends is directed to an intermediate position in the width direction of the bottom part, whereby the end of the electric wire, which is arranged between the bottom part and the bends, is fastened.

According to the terminal having the above mentioned structure, since the bends of the terminal are formed to be thin in comparison with the bottom parts, the bends can be deformed in such a manner that each end of the bends is directed to an intermediate position in the width direction of the bottom part and encroached upon the conductor of the wire securely. Therefore, even if tile thin wire is fastened to the terminal having a thick electric connecting part, the crimping connection can be attained with an appropriate crimping width (C/W) and appropriate crimping height (C/H).

In the preferred aspect of the present invention, the crimping part further includes another pair of bends which protrude from both sides of the bottom part. In the crimping operation, these bends are also deformed in such a manner that each end of the bends is directed to the intermediate position in the width direction of the bottom part, whereby the insulating part of the electric wire is fastened.

These and other objects and features of the present invention will become more fully apparent from the following description and appended claims taken in conjunction with the accompanying drawings.

BRIEF DESCRIPTION OF THE DRAWING

FIGS. 8A to 8C show a crimp-style terminal according to an embodiment of the present invention, in which FIG. 8A is a plan view thereof; FIG. 8B is a cross-sectional view taken along the line VIIIB—VIIIB of FIG. 8A; and FIG. 8C is a view on the bottom side of FIG. 8A;

DESCRIPTION OF THE PREFERRED EMBODIMENT

An embodiment of the present invention is now described with reference to the accompanying drawings.

Figure 1:
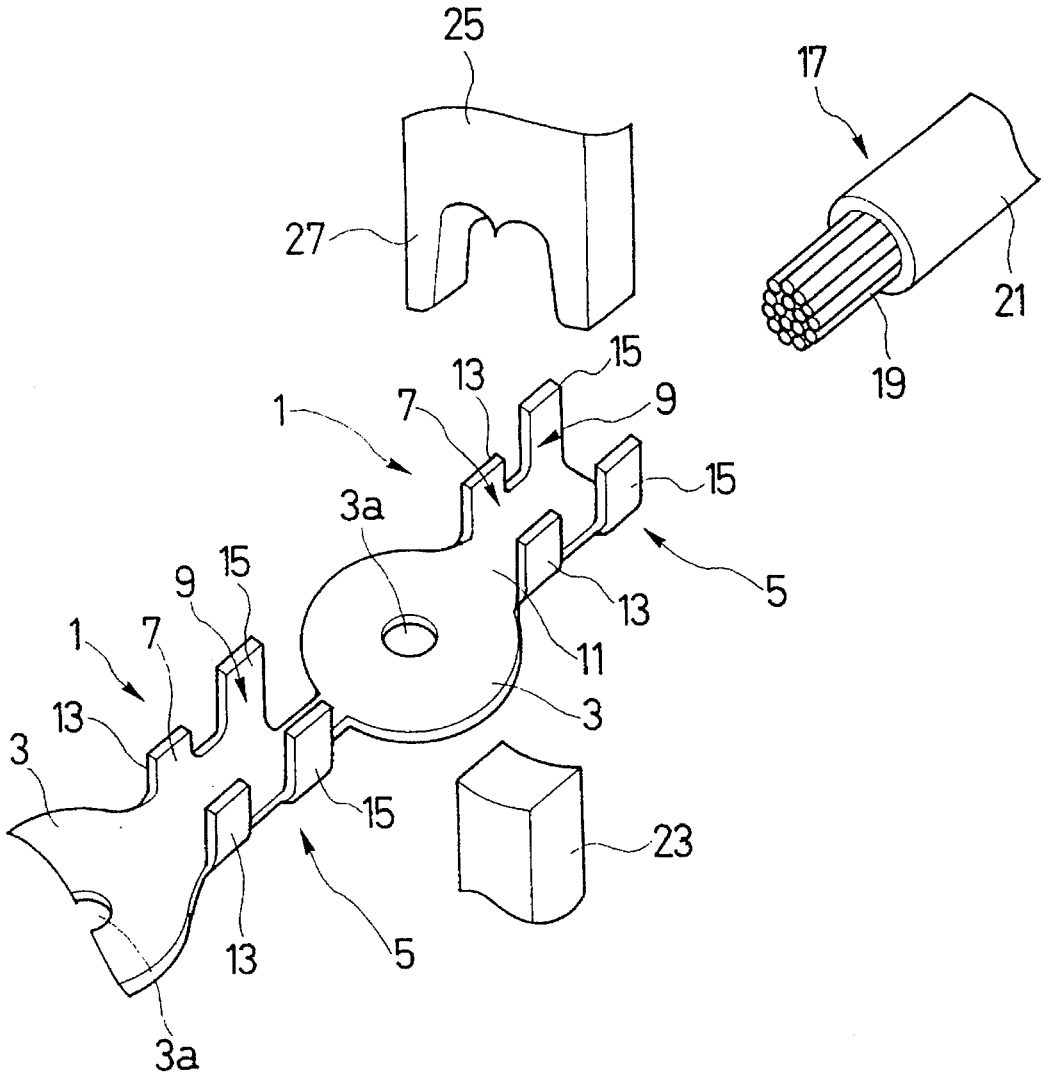
FIG. 1 is a perspective view showing an embodiment of crimp-style terminal according to the present invention and an upper die and lower die to crimp the terminal.
Figure 2:
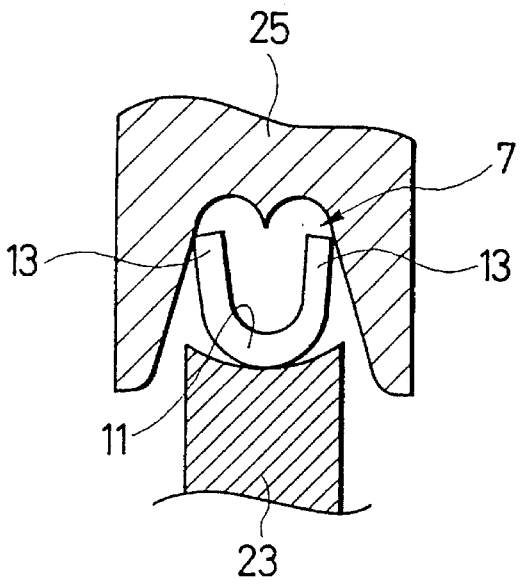
FIG. 2 is a sectional view showing a condition of crimping the crimp-style terminal.

FIG. 1 shows a crimp-style terminal 1 capable of linkage longitudinally. This crimp-style terminal 1 comprises an electric connecting part 3 and a crimping part 5 integrally formed therewith. In the assembled state of the terminal 1, the electric connecting part 3 is electrically connected with the other connecting part which is not shown in the figure. The connecting part 3 is provided with a mounting slot 3*a*. The crimping part 5 comprises a crimp segment 7 for holding a conductor(wires) 19 of the electric wire and another crimp segment 9 for holding an insulation 21 of the wire. The segment 7 is arranged adjacent to the part 3 and the segment 9 is arranged adjacent to the segment 7. The segment 7 is provided with a pair of bends 13 which are substantially U-shaped to protrude upward from both side edges of a bottom part 11 connected to the electric connecting part 3. Similarly, the segment 9 includes a pair of bends 15 which are of substantially U-shaped to protrude upward from both side edges of a bottom part 11.

When connecting the so constructed crimp-style terminal 1 with an electric wire end 17, bare wires 19 are mounted on the bottom part 11 of the crimp segment 7 and simultaneously, the insulator 21 covering the wires 19 Is mounted on the crimp segment 9. Upon such a positioning of the wire end 17 on the crimping part 5, the bottom part 11 is pinched between an lower die 23 and an upper die 25. Consequently, both of the bends 13 and 15 are deformed by a guide face 27 of the upper die 25, curling toward a substantially intermediate position in the width direction of the bottom part 11, whereby the crimp-style terminal 1 is crimped and electrically connected to the electric wire end 17. In general, the above-mentioned terminal 1 is designed to have enough thickness to satisfy the electrical and mechanical properties required for the electric connecting part 3. In addition, a barrel length of the crimping part 5, namely, the whole length of the bottom part 11 and the bends 13 is established corresponding to the thickness of the electric wire, i.e., the diameter of the conductor 19 and the diameter of the insulator 21. Further, when the terminal 1 is crimped, both width of the bottom part 11 and height of the crimped portion are respectively adjusted to obtain an appropriate holding force between the wire and the terminal and an appropriate connecting resistance therebetween. Note that, in this specification, the above width of the bottom part 11 will be referred as "C/W" (crimp wide) and the above height of the crimped portion will be referred as "C/H" (crimp height), hereinafter.

Figure 3:
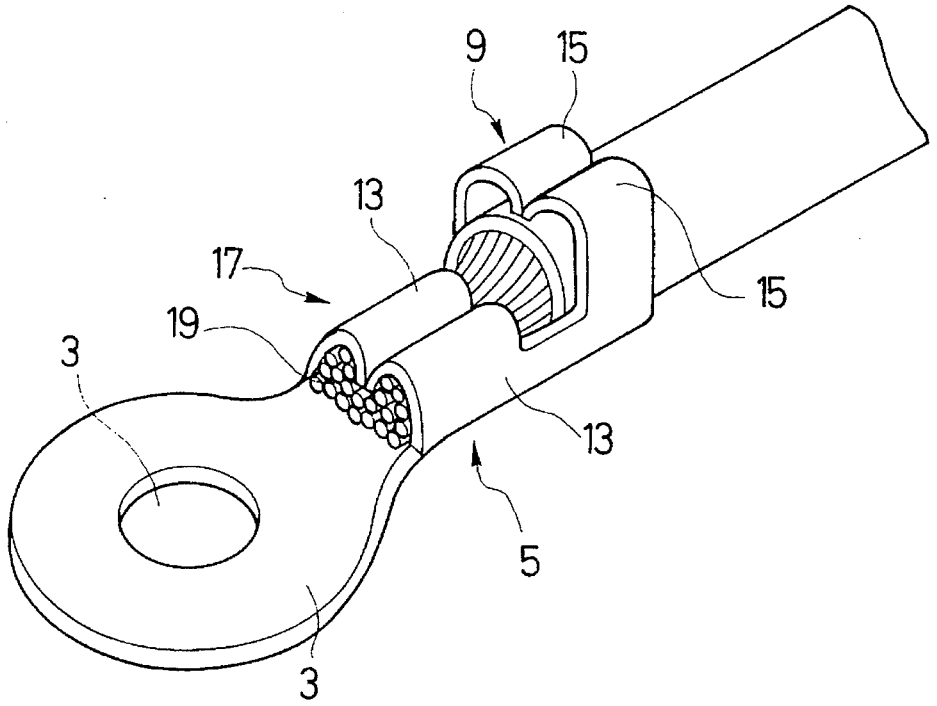
FIG. 3 is a perspective view showing a condition in which the electric wire is crimped by the crimp-style terminal.
Figure 4A:
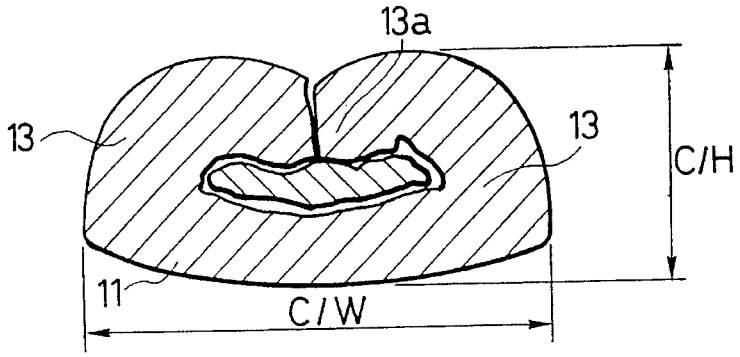
FIGS. 4A to 4D are sectional views showing various crimping forms in the crimp-style terminal.
Figure 4B:
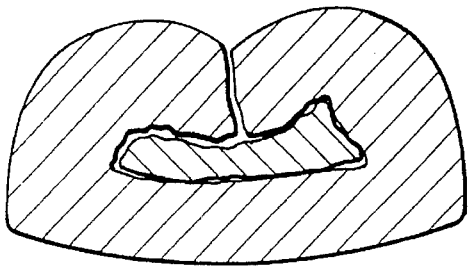
Figure 4C:
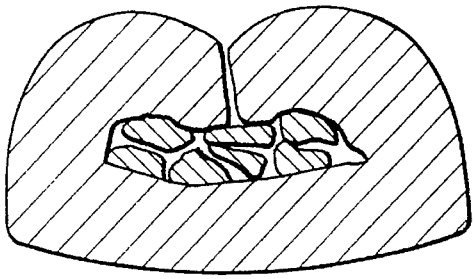
Figure 4D:
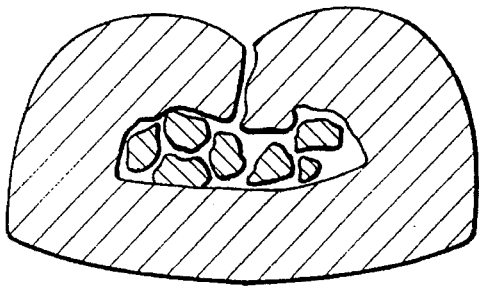

In the condition under which the wire end is fastened by the terminal 1, a crimp connection can be obtained where both ends of the bends 13 are bent in an arc to encroach upon the bare wires 19 as shown in FIG. 3, whereby high reliability can be obtained in terms of both holding force and connecting resistance.

There are instances where the electric conductor being fastened consists of bare wires each of which has a diameter smaller than the thickness of the crimp-style terminal 1. To take for example, such a case where the sectional area of the individual bare wire is less than 0.5 $mm^2$ while the thickness of the terminal is in excess of 0.6 mm. In case of crimping such a thin electric wire, the conductor 19 thereof cannot be crimped securely unless the C/W is decreased.

Figure 5:
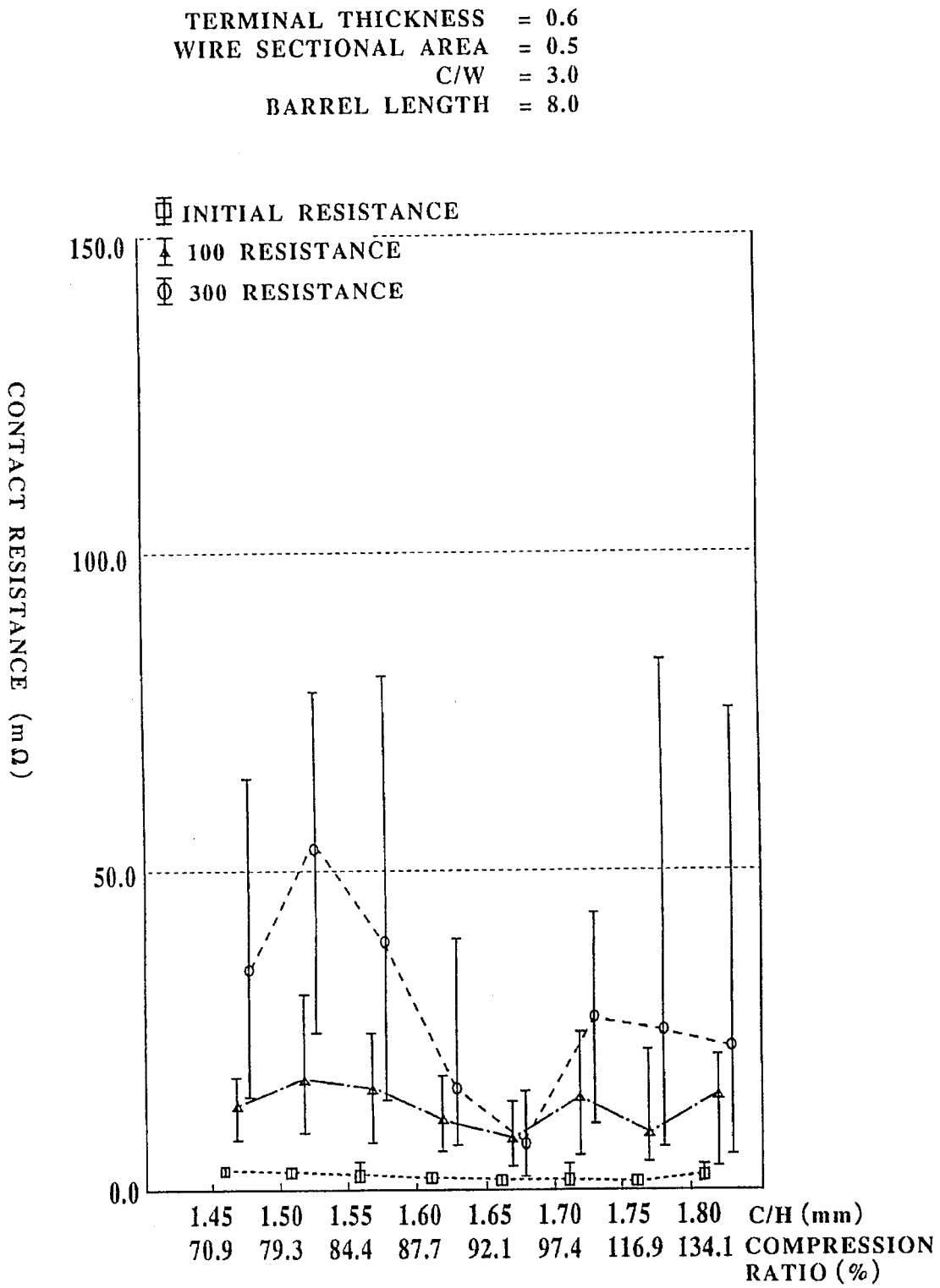
FIG. 5 is a diagram showing a deviation in the contact resistance with low voltage/current in tile terminal of FIGS. 4A to 4D.
Figure 6A:
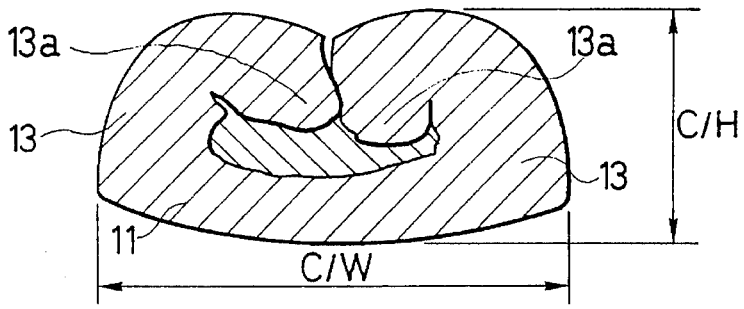
FIG. 6A to 6D are sectional views showing various crimping forms in the crimp-style terminal.
Figure 6B:
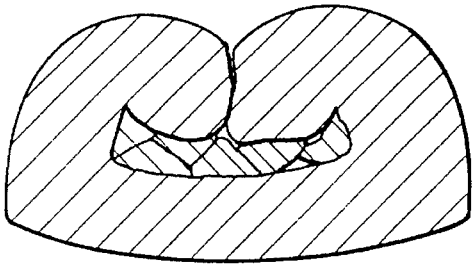
Figure 6C:
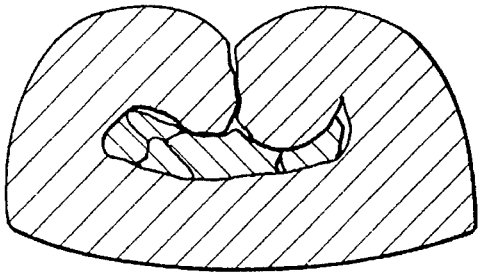
Figure 6D:
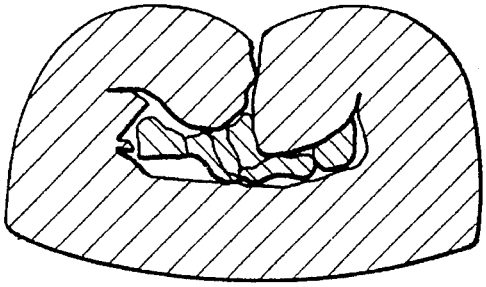

However, if the C/W is decreased to thereby fasten the terminal 1 with the thin wire, the bends 13 cannot be deformed in a condition under which the ends thereof follow the guide face of the upper die. Consequently, since both ends 13*a* of the bends 13 interfere with each other, as shown in FIGS. 4A to 4D, the ends 13*a* cannot be encroached upon the conductor 19. Under such crimping condition, as shown in FIG. 5, there will be produced a large deviation in the contact resistance with low voltage/current between the conductor 19 and the terminal 1, so that the electrical reliability is decreased.

Figure 7:
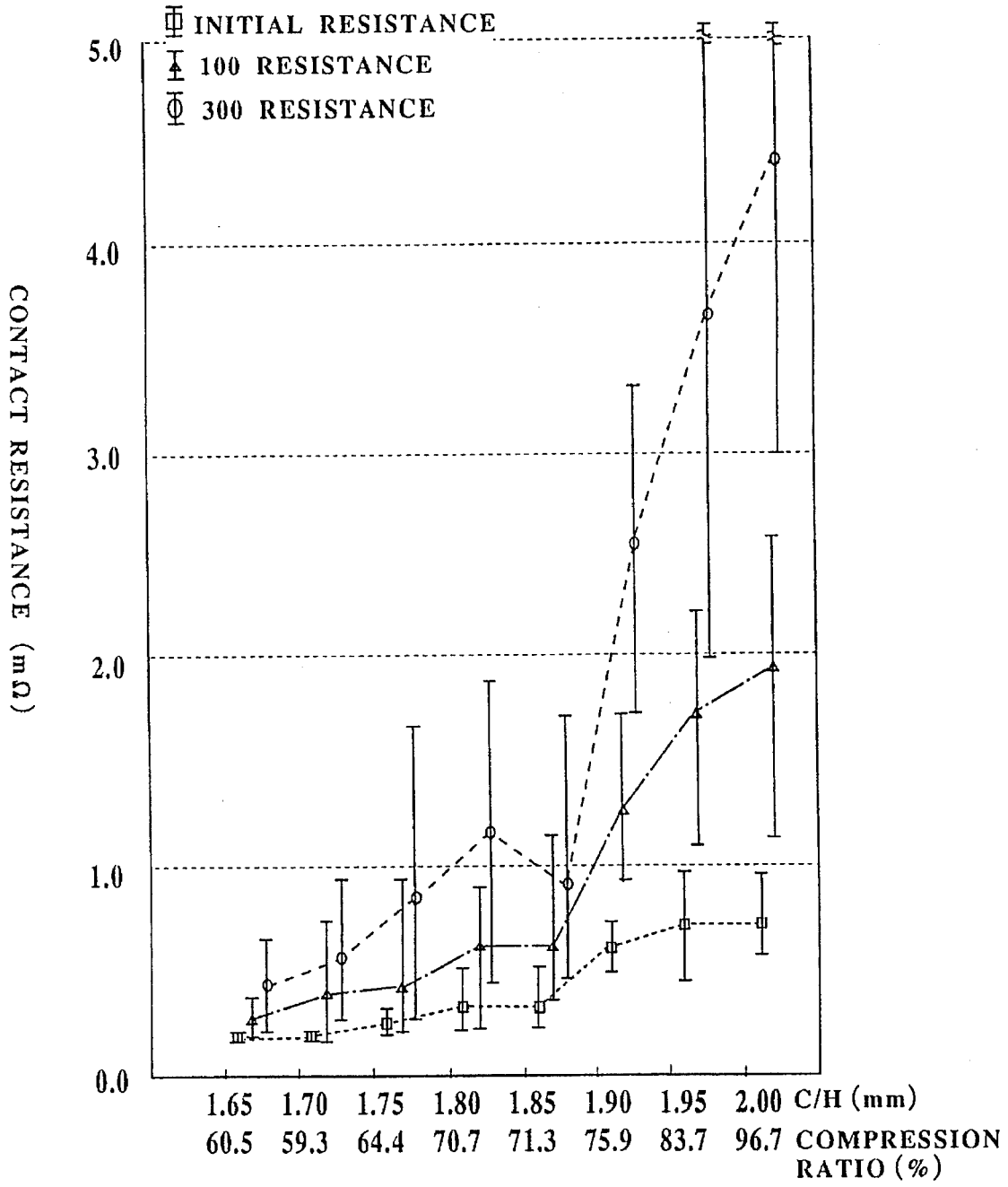
FIG. 7 is a diagram showing a deviation in the contact resistance with low voltage/current in the terminal of FIGS. 6A to 6D.

On the other hand, unless the C/W is increased a little (ex. 3.0 mm→3.15 mm), the bends 13 cannot be still deformed in an arc by the interference of both ends 13*a* thereof, whereby it is not possible to encroach the ends 13*a* upon the conductor, as shown in FIGS. 6A to 6D. Similarly in this case, as shown in FIG. 7, there will be produced a large deviation in the contact resistance with low voltage/current between the conductor 19 and the terminal 1, so that the electrical reliability is decreased.

Figure 8A:
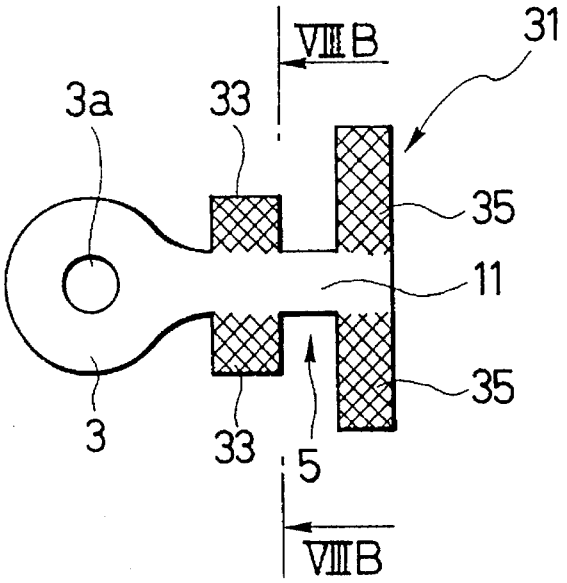
Figure 8B:
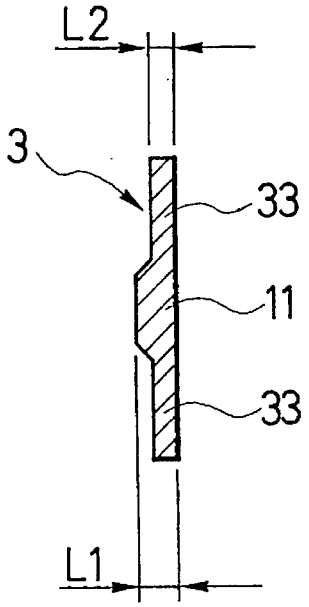
Figure 8C:
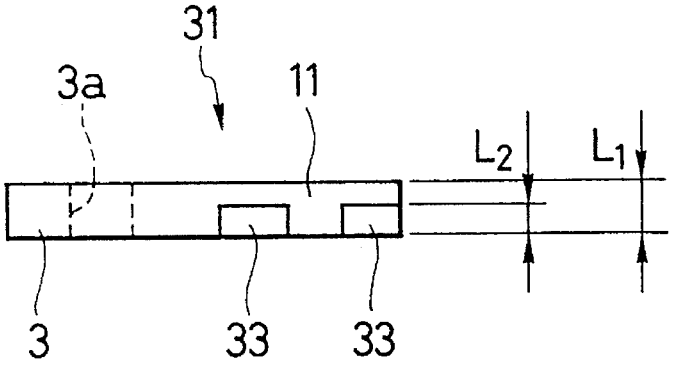

FIGS. 8A to 8C show a crimp-style terminal 31 of the embodiment of the present invention. In these figures, FIG. 8A is an unfolded plan view showing the terminal 31; FIG. 8B is a cross-sectional view taken along the line VIIIB—VIIIB of FIG. 8A; and FIG. 8C a side view of FIG. 8A.

As shown in FIGS. 8A through 8C, the crimp-style terminal 31 comprises an electric connecting part 3 and a crimping part 5 which includes a pair of bends 33 and another pair of bends 35. Each of the bends 33 and 35 is formed so as to protrude from each side edge of a bottom part 11 laterally.

Figure 9:
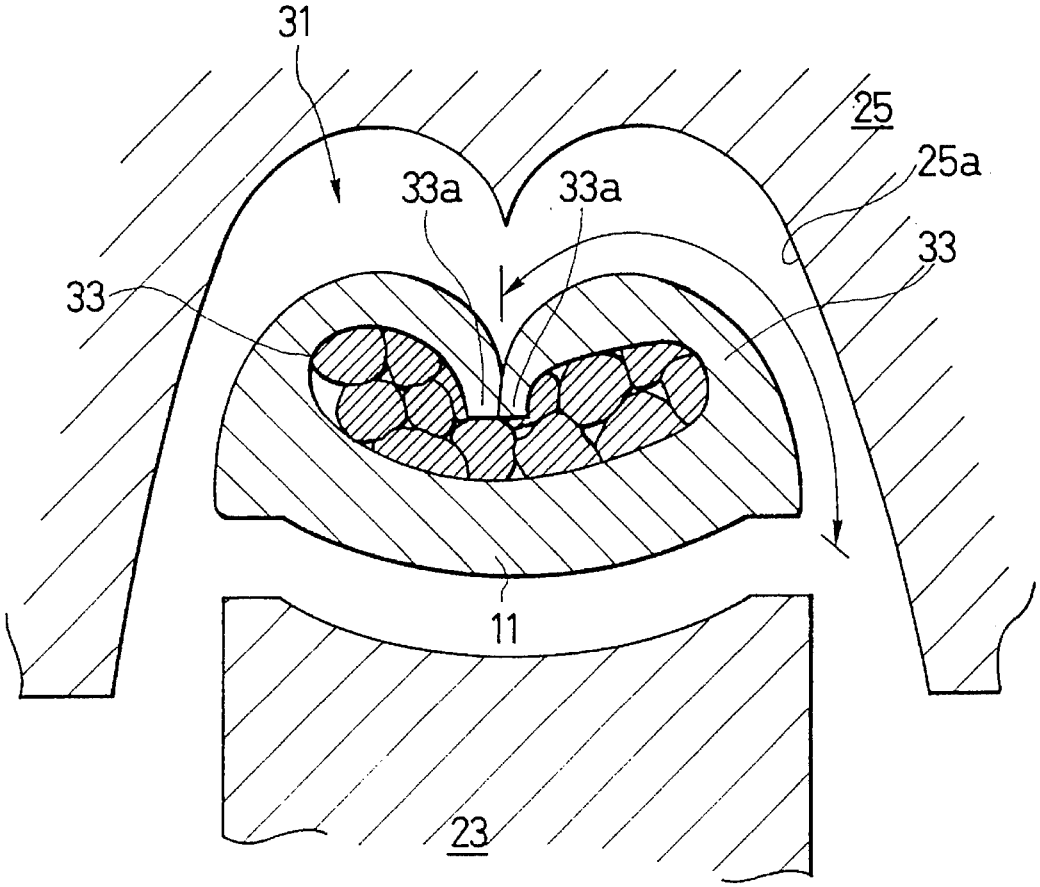
FIG. 9 is a sectional view showing an upper die and lower die to crimp the terminal and showing bends thereof in the crimped state.

As shown in FIGS. 8B and 8C, the bends 33 are formed to have a thickness of L2 less than a thickness of L1 of the bottom part 11. The thickness L2 of the bends 33 are preferably one half of the thickness L1 of the bottom part 11. The thickness L2 of the bends 33 are more preferably one-third to three quarters of the thickness L1 of the bottom part 11. In this way, since the plate thickness of the bends 33 is established to be partially thinner than the other parts to the extent of the arrow shown in FIG. 9, the bends 33 of the terminal 31 can be easily deformed inwardly, following an internal surface 25*a* of an upper die 25. The result of fastening the thin wire to the terminal 31 will be described below. Note that, in this embodiment, the fastening operation was carried out provided that the crimp-style terminal 31 had a thickness of 0.6 mm; and each of the bends 33 and 35 was 0.3 mm in thickness. Further, the terminal 31 had a barrel length of 5.6 mm; C/W of 2,0 mm and the sectional area of the wire was 0.5 $mm^2$.

Figure 10:
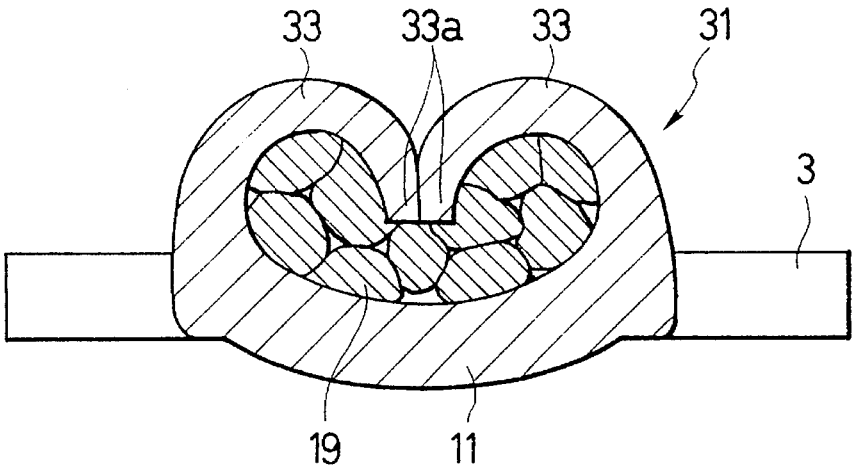
FIG. 10 is a sectional view showing the crimped terminal according to the embodiment of the present invention.
Figure 11:
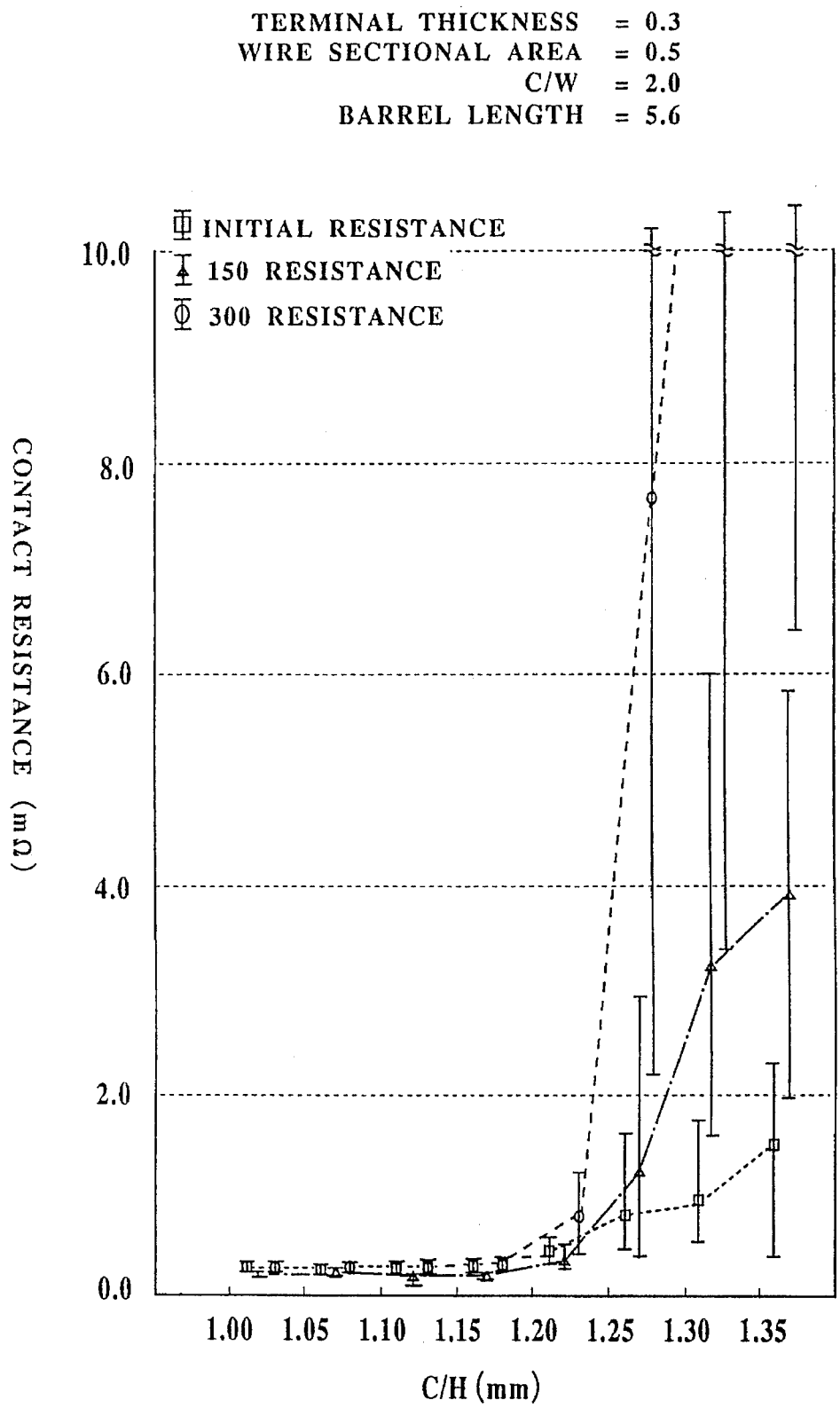
FIG. 11 is a diagram showing the contact resistance of the terminal according to the embodiment of the present invention.

As shown in FIG. 10, according to the present invention, the bends 33 of the crimp-style terminal 31 are encroached upon the conductor 19. Furthermore, the diagram FIG. 11 exhibits that, within the range of C/W less than 2.0 mm, the deviation of the contact resistance is very small in comparison with that of a C/W more than 2.0 mm.

In this way, according to the embodiment, due to such an establishment that the thickness of the bends 33 is less than that of the bottom 11, it is possible to fasten even the thin wire to the terminal 31 securely while satisfying the required performance with the electric connecting part 3.

Further, even when fastening the electric wire having a sectional area more than 0.5 $mm^2$, it is possible to encroach the ends 33*a* of the bends 33 upon the conductor 19 securely, so that the deviation in the contact resistance is small.

Therefore, according to the crimp-style terminal 31, is possible to extend the range of wire able to be fastened and to decrease the restriction in applicability.

As mentioned above, since the bends of the terminal are formed to be thin in comparison with the bottom parts, it is possible to easily deform the bends-so as to follow the internal surface of the upper die. Thus, even if the thin wire is fastened to the terminal having a thick electric connecting part, the resulting deviation in the contact resistance can be decreased, whereby the crimping connection can be obtained with high reliability.

Finally, it will be understood by those skilled in the art that the foregoing description of the preferred embodiments of the disclosed structure, and that; various changes and modifications may be made to the present invention without departing from the spirit and scope thereof.

What is claimed is:

1. A crimp-style terminal for connection with an end of an electric wire having a cross-sectional area, the terminal comprising:

an electric connecting part which is to be electrically connected to another connecting part; and a crimping part formed integrally with said electric connecting part, said crimping part including a bottom part and a pair of bends each having a distal end protruding from both sides of said bottom part, each of said bends being formed to be thinner than said bottom part;

wherein said pair of bends being deformed in such a manner: that each distal end of said bends is directed to a substantially intermediate position in the width direction of said bottom part of the crimping part, to deform the bends with a crimping width and a crimping height conforming to the cross-sectional area of the wire arranged between said bottom part and said bends, thereby forming an electrical connection between the crimping portion and the electric wire having a substantially repeatable electrical contact resistance therebetween.

2. A crimp-style terminal as claimed in claim 1, wherein a thickness of said bends is substantially one half of a thickness of said bottom portion.

3. A crimp-style terminal as claimed in claim 1, wherein a thickness of said bends is one-third to three quarters of a thickness of said bottom portion.

4. A crimp-style terminal as claimed in claim 1, wherein said bends are formed to be about 0.3 mm in thickness while said bottom part is formed to be about 0.6 mm in thickness.

5. A crimp-style terminal as claimed in claim 1, wherein said crimping part further includes another pair of bends each having a distal end protruding from both sides of said bottom part, said pair of bends being deformed in such a manner that each distal end of said bends is directed to said intermediate position in the width direction of said bottom part, whereby the insulating part of the electric wire is fastened.

6. A crimp-style terminal as claimed in claim 5, wherein said electric connecting part is provided &t a center thereof with a mounting slot.

7. A method for connecting a crimp-style terminal having a crimping part to an end of an electric wire having a cross-section, comprising the steps of:

providing an electric connecting part which is to be electrically connected to another connecting part, the crimping part including a bottom part and a pair of bends protruding from both sides of said bottom part, each of said bends having a length-wise thickness which is thinner than said bottom part, each of said bends having a distal end;

positioning the electrical wire adjacent to and substantially parallel with a lengthwise extent of the bottom part; and deforming the bends around the electrical wire and directing the distal ends of the bends to a substantially intermediate position of the electrical wire in the width-wise direction of the bottom part of the crimping part, to crimp the crimping part with a crimping width and a crimping height substantially conforming to the electrical wire cross-section, and provide an electrical connection between the terminal and the electric wire having a substantially repeatable electrical contact resistance therebetween.

8. The method as claimed in claim 7, comprising the additional step of providing a crimp-style terminal having bends formed with a thickness substantially equal to about one half of a thickness of said bottom portion.

9. The method as claimed in claim 7, comprising the additional step of providing a crimp-style terminal having bends formed with a thickness within the range of about one-third to about three quarters of a thickness of the bottom portion.

10. The method as claimed in claim 7, comprising the additional step of providing a crimp-style terminal having bends formed with a thickness of about 0.3 mm and providing a bottom part thickness of about 0.6 mm.

11. The method as claimed in claim 7, comprising the additional step of providing a crimp-style terminal having a second pair of bends protruding from opposite sides of the bottom part, and deforming the second pair of bends around an insulated portion at a substantially intermediate position of the electrical wire.

12. The method as claimed in claim 11, comprising the additional step of providing a mounting slot at a substantially center portion of the terminal.

* * * * *

UNITED STATES PATENT AND TRADEMARK OFFICE

CERTIFICATE OF CORRECTION

PATENT NO. :5,486,653

DATED :January 23,1996

INVENTOR(S) :Hikoo Kohi

It is certified that error appears in the above-identified patent and that said Letters Patent is hereby corrected as shown below:

At column 5, line 16, "&t" should read --at--.

Signed and Sealed this

Thirteenth Day of August, 1996

*Attest:*

*Attesting Officer*

BRUCE LEHMAN

*Commissioner of Patents and Trademarks*